US007985308B2

(12) United States Patent
Rudolf et al.

(10) Patent No.: US 7,985,308 B2
(45) Date of Patent: Jul. 26, 2011

(54) MULTIMODAL EXPLOSIVE

(75) Inventors: Karl Rudolf, Schrobenhausen (DE); Heinz Hofmann, Neunkirchen (DE); Dimitri Kovalev, Garching (DE); Joachim Diener, Ergoldsbach (DE)

(73) Assignee: Diehl BGT Defence GmbH & Co., KG (DE)

( * ) Notice: Subject to any disclaimer, the term of this patent is extended or adjusted under 35 U.S.C. 154(b) by 999 days.

(21) Appl. No.: 11/847,441

(22) Filed: Aug. 30, 2007

(65) Prior Publication Data

US 2008/0178974 A1 Jul. 31, 2008

Related U.S. Application Data

(63) Continuation of application No. PCT/EP2005/002902, filed on Mar. 18, 2005.

(30) Foreign Application Priority Data

Mar. 10, 2005 (DE) ..... 10 2005 011 535

(51) Int. Cl.
*C06B 45/00* (2006.01)

(52) U.S. Cl. ..... 149/2

(58) Field of Classification Search ..... 149/2
See application file for complete search history.

(56) References Cited

U.S. PATENT DOCUMENTS

| | | | | |
|---|---|---|---|---|
| 3,457,126 | A * | 7/1969 | Travers et al. | 149/2 |
| 3,462,324 | A | 8/1969 | Grant et al. | |
| 3,996,078 | A * | 12/1976 | Klunsch et al. | 149/2 |
| 4,331,080 | A | 5/1982 | West et al. | |
| 4,874,441 | A | 10/1989 | Bankhamer et al. | |
| 6,019,861 | A * | 2/2000 | Canterberry et al. | 149/19.1 |
| 6,803,244 | B2 | 10/2004 | Diener et al. | |

FOREIGN PATENT DOCUMENTS

| | | | |
|---|---|---|---|
| DE | 202 01 938 | U1 | 2/2002 |
| DE | 102 04 895 | A1 | 8/2003 |
| DE | 10204834 | A1 * | 8/2003 |
| GB | 1 411 822 | A | 9/1973 |
| WO | 02/34696 | A2 | 5/2002 |
| WO | 2004/069771 | A1 | 8/2004 |

OTHER PUBLICATIONS

"Munchener Forscher finden durch Zufall Super-Sprengstoff aus porosem Silizium",wissenschaft. de, Konradin RElations GmbH 2006; Seite 1, von 1; http://www.wissenschaft.de/wissenschaft/news/drucken/152649.html.

Li, et al., "Surface Functionalization of Silicon Nanoparticles Produced by Laser-Driven Pyrolysis of Silane Followed by HF-HNO3 Etching", Langmuir 2004, 20, 4720-4727; Document No. XP-002355879.

Miura, et al., "Initial Stages of Oxidation of Hydrogen-Terminated Si Surface Stored in Air", Apllied Surface Science 100/101 (1996) 454-459; Document No. XP-002355807; and.

Liu, et al., "A New Synthetic Route for the Synthesis of Hydrogen Terminated Silicon Nanoparticles", Materials Science and Engineering B96 (2002) 72-75; Document No. XP-002355806.

* cited by examiner

*Primary Examiner* — Aileen Felton
(74) *Attorney, Agent, or Firm* — Scully, Scott, Murphy & Presser, P.C.

(57) ABSTRACT

A multimodal explosive, in particular for blast charges, which has, for increasing the power, a powder additive which is formed by a hydrogen-terminated monocrystalline silicon powder of at least one grain size range, which powder has the advantage that no oxidation phenomenon takes place even over many years—even at storage in ambient air. Due to the non-oxidized crystal surfaces, advantageously an immediate joint reaction with the explosive takes place in the detonation front and also extends into the post-reaction period with increasing crystal sizes, so that a different propellant effect is achieved depending on the additive.

4 Claims, No Drawings

MULTIMODAL EXPLOSIVE

CROSS-REFERENCE TO RELATED APPLICATION

This application is a continuation application of PCT/EP2005/002902; filed Mar. 18, 2005.

BACKGROUND OF THE INVENTION

1. Field of the Invention

The present invention relates to an explosive, such as a multimodal explosive, in particular, for blast charges.

In the case of explosives, in particular for blast charges, aluminum powder has been used to date as a powder additive for increasing the power (i.e. increasing the pressure effect). The explosive used is, for example, RDX (=hexogen) or HMX (=octogen). The theoretically achievable increase in the detonation pressure owing to liberation of heat in the reaction with the large proportions of liberated carbon atoms of, for example, RDX or HMX is observable only in very rare cases with the use of an aluminum powder as a powder additive. With the use of non-oxidized aluminum powder, for example, an increase of about 12% in the fragment velocity can be observed. However, this increase in the fragment velocity is lost within a few weeks since pure aluminum powder rapidly builds up a multiplicity of aluminum oxide layers on the powder surface. Several thousand layers of aluminum oxide can form on the aluminum powder surface. This oxide layer has a high melting point and is very resistant to wear, so that a post-reaction can take place only in the millisecond range, and only then does improved blast behavior occur above and below water. However, investigations to date have shown that overall only a relatively small proportion of the aluminum powder reacts. This small proportion of aluminum powder which reacts is of the order of magnitude of not more than 20%.

2. Discussion of the Prior Art

German Patent Publication DE 102 04 895 A1 discloses nanostructured porous reactive substances which consist of reactive bodies whose cavities are in the size range from 1 to 1000 nm, which are provided with oxidizing agents. The reactive substances consist of reactive particles which are independent of one another and are enveloped by a protective layer. A process for the production of such reactive substances is also described there, nm size fuel particles which have interstices measuring from 1 to 1000 nm first being provided with a protective layer by heating at from 20 to 1000° C. in air or by chemical or electrochemical processes or by vapor deposition processes and the interstices then being provided with an oxidizing agent. The fuel particles provided with the protective layer and the oxidizing agent can be pressed to give a reactive body. The fuel particles may consist of silicon, boron, titanium or zirconium.

SUMMARY OF THE INVENTION

It is the object of the invention to provide an explosive, in particular for blast charges, of the type mentioned hereinabove, which explosive has improved blast behavior above and below water.

This object is achieved, according to the invention, by the provision of a multimodal expositive, which includes a powder additive for increasing the power of secondary explosives, wherein the powder additive is formed by a hydrogen-terminated monocrystalline silicon powder of at least one or more grain size ranges of the multimodal explosive. Preferred developments and further developments of the explosive according to the invention are set forth in the dependent claims.

DETAILED DESCRIPTION OF THE INVENTION

In the course of work with quasi-pure silicon, it was surprisingly found that, owing to their surface properties, hydrogen-passivated monocrystalline silicon powders shows no oxidation phenomena even over many years. This is true even in the case of the storage of silicon nanopowders in ambient air. Monocrystalline silicon powders have virtually the same heat of combustion and reactivity as pure aluminum powder, i.e. non-oxidized aluminum powder.

In experiments with oxidizers, silicon nanocrystals showed very vigorous reaction behavior.

It has been found that hydrogen-passivated silicon powder is a substantially more interesting additive than the aluminum powder used to date in secondary explosive mixtures, since, owing to the non-oxidized crystal surfaces of the silicon powder, an immediate joint reaction takes place in the detonation front and also extends into the post-reaction period with increasing crystal sizes. Thus, with increasing crystal sizes, a so-called propellant effect, i.e. a prolongation of the detonation pressure pulse, is achieved. Thus, an immediate substantial contribution to the detonation front is achieved during the explosive reaction, for example, with silicon powder which has long-term stability, i.e. is non-oxidized, and has the grain size of about 1 μm, and an additional post-reaction and hence a propellant effect are achieved with the use of coarse grains of, for example, 350 μm.

In the case of the explosive according to the invention, in particular for blast charges, which comprises a hydrogen-passivated silicon powder additive to secondary explosives which is formed by monocrystalline silicon powder for increasing the power, for example, the first grain size range of the monocrystalline silicon powder, beginning with a grain level of 350 μm (mean value), can be formed by monocrystalline silicon powder which has a grain size of about 1 μm-8 μm, and the second grain size range of monocrystalline silicon powder may be about 40 μm and the third range may be from 200 to 500 μm, preferably about 350 μm, in particular after use of only one grain size range or a mixture of the abovementioned fractions. The proportion of monocrystalline silicon powder may be 15-55% by weight.

The applications with preferred use of such silicon single crystals are:

- Very fast joint reactions of 1-8 μm for increased metal acceleration capability.
- Prolonged pressure application at about 40 μm in underwater and propellant use.
- Greatly prolonged pressure application at about 350 μm in virtually or completely closed structures.

What is claimed is:

1. A multimodal explosive, comprising a powder additive for increasing the power of secondary explosives, wherein the powder additive includes a hydrogen-terminated monocrystalline silicon powder having at least a first grain size from about 1 μm to 8 μm, a second grain size from about 20 μm to 50 μm and a third grain size from about 200 μm to 500 μm.

2. The explosive as claimed in claim 1, wherein said second grain size is about 40 μm.

3. The explosive as claimed in claim 1, wherein the said third grain size is about 350 μm.

4. The explosive as claimed in claim 1, wherein the proportion by weight of the monocrystalline silicon powder to the explosive is about 15-55% by weight.

* * * * *